US012790780B2

(12) United States Patent
Kaesgen et al.

(10) Patent No.: US 12,790,780 B2
(45) Date of Patent: Nov. 10, 2026

(54) POWER MANAGEMENT FOR MULTI-STAGE MOTOR CONTROL OF MULTI-STAGE SNOW THROWER

(71) Applicant: MTD PRODUCTS INC, Valley City, OH (US)

(72) Inventors: Derek Kaesgen, Cleveland, OH (US); Axel Schaedler, Olmsted Falls, OH (US)

(73) Assignee: MTD Products Inc, Valley City, OH (US)

( * ) Notice: Subject to any disclaimer, the term of this patent is extended or adjusted under 35 U.S.C. 154(b) by 464 days.

(21) Appl. No.: 18/378,742

(22) Filed: Oct. 11, 2023

(65) Prior Publication Data

US 2024/0117581 A1 Apr. 11, 2024

Related U.S. Application Data

(60) Provisional application No. 63/415,102, filed on Oct. 11, 2022.

(51) Int. Cl.
*E01H 5/09* (2006.01)

(52) U.S. Cl.
CPC ..... *E01H 5/098* (2013.01)

(58) Field of Classification Search
CPC ..... E01H 5/098
See application file for complete search history.

(56) References Cited

U.S. PATENT DOCUMENTS

| | | | | |
|---|---|---|---|---|
| 2014/0202047 | A1* | 7/2014 | Kawakami | E01H 5/098 37/257 |
| 2017/0015342 | A1* | 1/2017 | Schmalz | E01H 5/045 |
| 2021/0040701 | A1* | 2/2021 | Yamaoka | E01H 5/098 |
| 2022/0098811 | A1* | 3/2022 | Bonney | E01H 5/098 |
| 2024/0068190 | A1* | 2/2024 | Duchscherer | H02P 23/14 |

* cited by examiner

*Primary Examiner* — Matthew R Buck
(74) *Attorney, Agent, or Firm* — Wegman Hessler

(57) ABSTRACT

Power management systems for snow throwers, snow throwers employing such power management systems, and methods of managing power in a snow thrower are discussed. One example embodiment comprises: an auger power control system configured to provide a first power to one or more augers; an impeller power control system configured to provide a second power to an impeller; and a drive power control system configured to provide a third power to one or more drive elements; and wherein, in response to at least one of a user input, a change in a first load on the one or more augers, a change in a second load on the impeller, or a change in a third load on the one or more drive elements, at least one of the first power, the second power, or the third power is increased or decreased.

31 Claims, 7 Drawing Sheets

POWER MANAGEMENT FOR MULTI-STAGE MOTOR CONTROL OF MULTI-STAGE SNOW THROWER

CROSS-REFERENCE TO RELATED APPLICATIONS

This application claims the benefit of U.S. Provisional Patent Application 63/415,102 filed Oct. 11, 2022, the entirety of which is hereby incorporated by reference within the present disclosure in its entirety and for all purposes.

FIELD OF DISCLOSURE

This application relates generally to snow throwing power equipment, and more specifically to power management between stages of snow throwing power equipment including at least two stages.

BACKGROUND

Snow removal machines typically include housings with a forward opening through which material enters the machine. At least one rotatable member (auger) is positioned and rotatably secured within the housing for engaging and eliminating the snow from within the housing. Snow blower technology is generally focused on designs whereby flighted augers move snow axially toward an impeller that is driven integrally (single stage) or independently driven (two-stage, three-stage, etc.). Impellers are usually devices such as discs and blades that are shaped and configured such that when rotated they receive materials (snow) and then centrifugally discharge the materials through openings in the housings and then into chutes that control and direct the materials.

Existing snow throwers can effectively clear light amounts of snow. However, in situations involving larger quantities of snow, heavy snow, and/or wet snow, existing snow throwers can become bogged down or even stall as they struggle to move the snow or slush past the impeller and out of the snow thrower.

SUMMARY

The following presents a simplified summary in order to provide a basic understanding of some example aspects of the disclosure. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

According to one aspect, a first example snow thrower is disclosed. The first example snow thrower comprises one or more drive elements configured to move the snow thrower; an impeller configured to expel snow from the snow thrower; one or more augers configured to provide the snow to the impeller; an auger power control system configured to provide a first power to the one or more augers; an impeller power control system configured to provide a second power to the impeller; and a drive power control system configured to provide a third power to the one or more drive elements; wherein, in response to at least one of a user input, a change in a first load on the one or more augers, a change in a second load on the impeller, or a change in a third load on the one or more drive elements, at least one of: the auger power control system is configured to one of increase or decrease the first power; the impeller power control system is configured to one of increase or decrease the second power; or the drive power control system is configured to one of increase or decrease the third power.

According to another aspect, a second example snow thrower is disclosed. The second example snow thrower comprises one or more drive elements configured to move the snow thrower; an impeller configured to expel snow from the snow thrower; one or more augers configured to provide the snow to the impeller; an auger power control system comprising an auger motor configured to rotate the one or more augers according to a first power and an auger motor controller configured to drive the auger motor according to the first power; an impeller power control system comprising an impeller motor configured to rotate the impeller according to a second power and an impeller motor controller configured to drive the impeller motor according to the second power; and a drive power control system comprising a drive motor configured to rotate the one or more drive elements according to a third power and a drive motor controller configured to drive the drive motor according to the third power; wherein, in response to at least one of a user input, a change in a first load on the one or more augers, a change in a second load on the impeller, or a change in a third load on the at least one drive element, at least one of: the auger power control system is configured to one of increase or decrease the first power; the impeller power control system is configured to one of increase or decrease the second power; or the drive power control system is configured to one of increase or decrease the third power.

According to another aspect, an example power management system for a snow thrower is disclosed. The example power management system comprises an auger power control system configured to provide a first power to one or more augers; an impeller power control system configured to provide a second power to an impeller; and a drive power control system configured to provide a third power to one or more drive elements; wherein, in response to at least one of a user input, a change in a first load on the one or more augers, a change in a second load on the impeller, or a change in a third load on the one or more drive elements, at least one of: the auger power control system is configured to one of increase or decrease the first power; the impeller power control system is configured to one of increase or decrease the second power; or the drive power control system is configured to one of increase or decrease the third power.

To accomplish the foregoing and related ends, certain illustrative aspects of the disclosure are described herein in connection with the following description and the drawings. These aspects are indicative, however, of but a few of the various ways in which the principles of the disclosure can be employed and the subject disclosure is intended to include all such aspects and their equivalents. Other advantages and features of the disclosure will become apparent from the following detailed description of the disclosure when considered in conjunction with the drawings.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
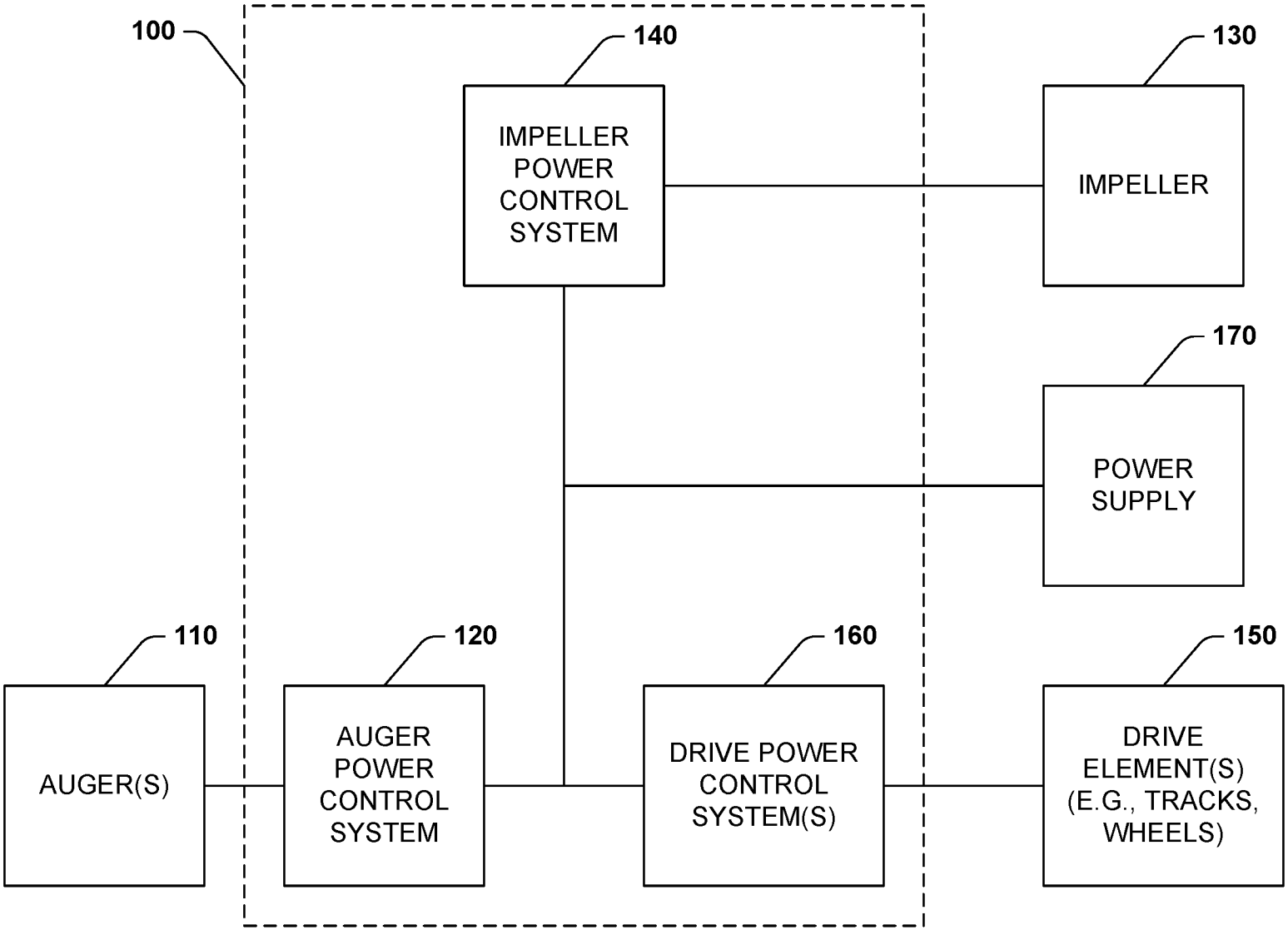
FIG. 1 illustrates an example power management system that can facilitate distribution of power between two or more of auger(s), an impeller, and/or drive element(s) of a snow thrower, according to various aspects discussed herein.

It should be noted that the drawings are diagrammatic and not drawn to scale. Relative dimensions and proportions of parts of the figures have been shown exaggerated or reduced in size for the sake of clarity and convenience in the drawings. The same reference numbers are generally used to refer to corresponding or similar features in the different embodiments, except where clear from context that same reference numbers refer to disparate features. Accordingly, the drawings and description are to be regarded as illustrative in nature and not as restrictive.

While embodiments of the disclosure pertaining to providing user feedback and enhanced drivability in drive-by-wire systems for power equipment machines are described herein, it should be understood that the disclosed machines, electronic and computing devices and methods are not so limited and modifications may be made without departing from the scope of the present disclosure. The scope of the systems, methods, and electronic and computing devices for providing user feedback and enhanced drivability in drive-by-wire systems are defined by the appended claims, and all devices, processes, and methods that come within the meaning of the claims, either literally or by equivalence, are intended to be embraced therein.

DETAILED DESCRIPTION

Example embodiments that incorporate one or more aspects of the present disclosure are described and illustrated in the drawings. These illustrated examples are not intended to be a limitation on the present disclosure. For example, one or more aspects of the present disclosure can be utilized in other embodiments and even other types of devices. Moreover, certain terminology is used herein for convenience only and is not to be taken as a limitation on the present disclosure. Still further, in the drawings, the same reference numerals are employed for designating the same elements.

Referring to FIG. 1, illustrated is an example power management system 100 that can facilitate distribution of power between two or more of auger(s) 110, an impeller 130, and/or drive element(s) 150 of a snow thrower (e.g., snow thrower 10, discussed in greater detail below, or another snow thrower, etc.), in connection with various aspects discussed herein. System 100 can comprise auger power control system 120 (which can control rotation (e.g., speed, torque, etc.) of auger(s) 110, etc.), impeller power control system 140 (which can control rotation (e.g., speed, torque, etc.) of impeller 130, etc.), drive power control system(s) 160 (which can comprise one or more control systems that control rotation (e.g., speed, torque, etc.) of drive element(s) 150, etc.), and optionally power supply 170 (which can provide power to auger power control system 120, impeller power control system 140, and/or drive power control system(s) 160 to control rotation of auger(s) 110, impeller 130, and/or drive element(s) 150, respectively, and can be, depending on the embodiment, within or separate from system 100). Some embodiments can comprise a single drive power control system that controls all drive element (s), while other embodiments can comprise two or more drive power control systems that provide separate control of two or more drive elements (e.g., for skid-steer or tracked rotation, to handle scenarios where snow load is distributed unevenly across the front of the snow thrower, etc.). In system 100, auger power control system 120, impeller power control system 140, and drive power control system(s) 160 are illustrated separately, and some embodiments can provide independent power control for each of auger(s) 110, impeller 130, and drive element(s) 150, respectively. In other embodiments, two of auger power control system 120, impeller power control system 140, and drive power control system(s) 160 can operate jointly (e.g., auger power control system 120 and impeller power control system 140, or any other pair), and can provide power control for each of auger(s) 110, impeller 130, and drive element(s) 150, respectively, that can be at a fixed ratio relative to each other for the two power control system(s) operating jointly, but independent of the other power control system(s).

In various embodiments, auger power control system 120, impeller power control system 140, and/or drive power control system(s) 160 can control (e.g., increase or decrease) power to auger(s) 110, impeller 130, and/or drive element(s) 150, respectively, in response to load(s) on any of auger(s) 110, impeller 130, and/or drive element(s) 150, and/or in response to user input. The specific manner in which power to auger(s) 110, impeller 130, and/or drive element(s) 150 is controlled can vary based on the specific embodiment and/or scenario, some of which are discussed herein. However, although specific embodiments and scenarios are discussed, these are solely for the purposes of illustration, and are not intended to limit the scope of the appended claims.

Additionally, in various embodiments, auger(s) 110, impeller 130, and/or drive element(s) 150 (and potentially one or more drive element(s) 150 from one or more other drive element(s) 150) can be mechanically decoupled from one another such that each can rotate independently of those from which it is mechanically decoupled. In such embodiments, mechanically decoupled components can have their power and/or rotational speed increased or decreased (e.g., via auger power control system 120, impeller power control system 140, and/or drive power control system 160) without affecting the power or speed of those from which they are decoupled.

Depending on the embodiment, auger power control system 120, impeller power control system 140, and/or drive power control system 160 can control power to auger(s) 110, impeller 130, and/or drive element(s) 150, respectively, one or more of mechanically, electrically, electronically, hydraulically, hydrostatically, pneumatically, etc. Depending on the embodiment, auger power control system 120, impeller power control system 140, and/or drive power control system 160 can be configured to automatically respond to increasing or decreasing load on auger(s) 110, impeller 130, and/or drive element(s) 150 according to one or more aspects discussed herein (e.g., via a gear ratio of impeller power control system 140 that automatically changes based on load on impeller 130, etc.), and/or the relevant load(s) can be sensed (e.g., via current draw of a motor or via another sensor, e.g., an inline torque sensor, etc.) and power to auger(s) 110, impeller 130, and/or drive element(s) 150 can be controlled based on the sensed load.

Figure 2:
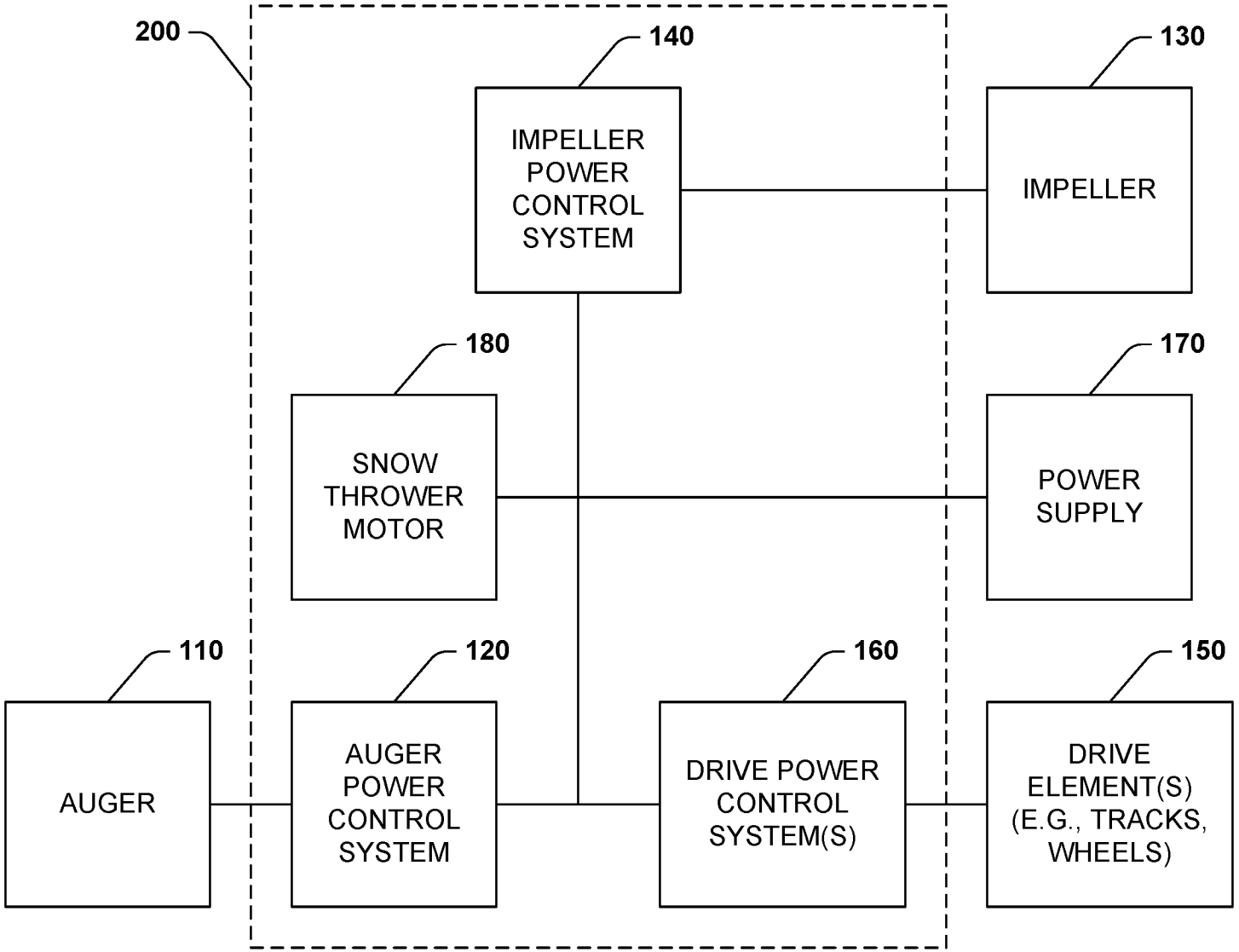
FIG. 2 illustrates an example power management system driven via a single snow thrower motor, in accordance with various aspects discussed herein.

As a first set of example embodiments, FIG. 2 illustrates example power management system 200 driven via a single snow thrower motor 180, in accordance with various aspects discussed herein. In FIG. 2, power management system 200 can comprise and/or receive rotational energy from a single snow thrower motor 180, which can act as a single prime mover to drive each of auger power control system 120, impeller power control system 140, and drive power control system 160, which can control power to auger(s) 110, impeller 130, and drive element(s) 150, respectively, via torque converters/clutches/differential gearing (e.g., including continuously variable transmission (CVT) clutches, etc.), flow(s)/pressure(s)/volume(s) of a fluid (e.g., a liquid or a gas) via pump(s)/valve(s)/motor(s), electric current(s), etc., depending on the embodiment.

Figure 3:
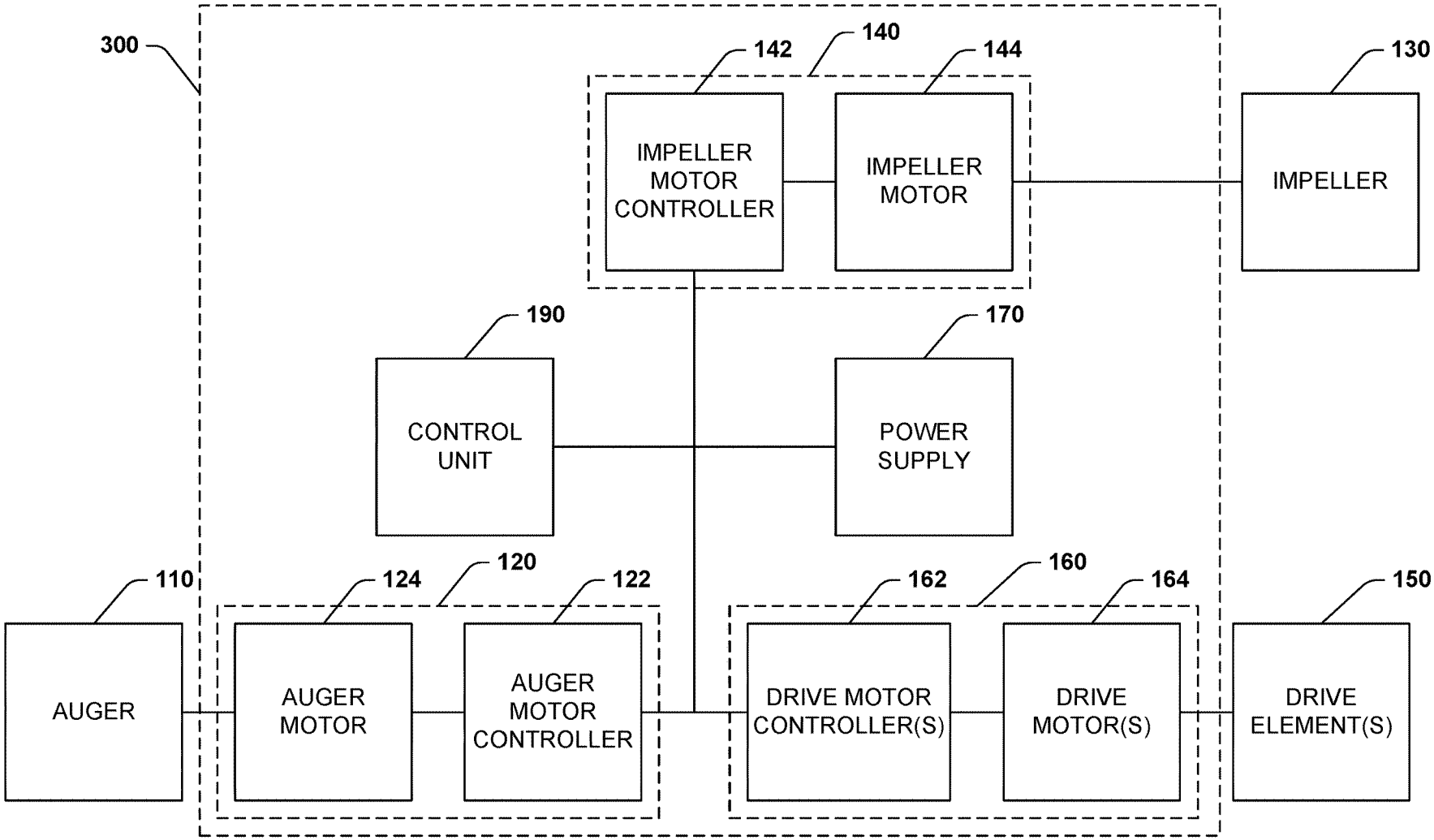
FIG. 3 illustrates an example power management system that drives auger(s), impeller, and drive element(s) via independent motors, in accordance with various aspects discussed herein.

As a second set of example embodiments, FIG. 3 illustrates example power management system 300 that drives auger(s), impeller, and drive element(s) via independent motors, in accordance with various aspects discussed herein. In FIG. 3, auger power control system 120 can comprise auger motor 124 and auger motor controller 122 that can drive the auger motor 124 to rotate auger(s) 110. Similarly, impeller power control system 140 can comprise impeller motor 144 and impeller motor controller 142 that can drive the impeller motor 144 to rotate impeller 130, and drive power control system 160 can comprise drive motor(s) 164 and drive motor controller(s) 162 that can drive the drive motor(s) 164 to rotate drive element(s) 150. In some embodiments, one or more of auger motor controller 122, impeller motor controller 142, and/or drive motor controller(s) 162 can be controlled based on signal(s) received from one or more optional separate control units 190 and/or via circuitry local to that power controller (120, 140, or 160).

Although not illustrated, additional embodiments exist wherein two or more of auger(s) 110, impeller 130, and drive element(s) 150 are driven by a first motor, and at least one of auger(s) 110, impeller 130, and drive element(s) 150 are driven by a second motor distinct from the first motor (e.g., auger(s) 110 and impeller 130 can be driven by a first motor and drive element(s) 150 can be driven by a second motor, etc.).

Increased or decreased loads on auger(s) 110, impeller 130, and/or drive element(s) 150 can occur in various snow clearing scenarios, and various embodiments can increase, decrease, or keep constant power to one or more of auger(s) 110, impeller 130, and/or drive element(s) 150 to facilitate operation of a snow thrower (e.g., snow thrower 10, etc.) employing system 100 in such scenarios. In some embodiments, power can be shifted between auger(s) 110, impeller 130, and/or drive element(s) 150 to increase power to the component(s) seeing higher load(s). Some embodiments can select power levels for the auger(s) 110, impeller 130, and drive element(s) 150 can be determined based on loads on the auger(s) 110, impeller 130, and drive element(s) 150. In such embodiments, each triple (or quadruple, etc., depending on drive element(s) 150) of load values for auger(s) 110, impeller 130, and drive element(s) 150 can be mapped by a function (e.g., implemented by control unit 190 and/or the power control systems, etc.) to power values for auger(s) 110, impeller 130, and drive element(s) 150 (to be applied by auger power control system 120, impeller power control system 140, and drive power control system(s) 160). In various embodiments, one or more sensors or load values (e.g., those for auger(s) 110, or impeller 130, etc.) can be prioritized over others for determining power control for auger(s) 110, impeller 130, and/or drive element(s) 150, or can be prioritized when their load value(s) are within a given range. For example, while the load on impeller 130 is within a given range, the snow thrower can maintain or increase speed of drive element(s) 150 until the load on impeller 130 exceeds an upper bound of the given range, at which point, power to impeller 130 can be increased, and power to auger(s) 110 and/or drive element(s) 150 can also change as discussed herein. Alternatively, similar behavior can be employed based on the load on auger(s) 110 (where increased load beyond a given range can trigger power increasing at impeller 130 and/or auger(s) 110, power optionally decreasing at drive element(s) 150, etc.) and/or drive element(s) 150 (e.g., where increased load can be indicative of load potentially about to increase on other components, etc.).

Additionally or alternatively, specific example scenarios and embodiments are provided below. However, it is to be appreciated that other embodiments can manage power (e.g., increasing, decreasing, or keeping constant) for auger(s) 110, impeller 130, and/or drive element(s) 150 differently than provided in the following examples. In various embodiments, power changes in response to an increased or decreased load can be in response to any change in load, change above or below value(s) (e.g., nominal value(s), value(s) associated with optimal operation, etc.), change greater than a threshold amount, etc.

An increased load on auger(s) 110 can result from increased rate of mass moved by auger(s) 110 (e.g., more (deeper, etc.) snow and/or heavier (e.g., denser, wet, etc.) snow). In various embodiments, increased load on auger(s) 110 can trigger auger power control system 120 to increase power to auger(s) 110 (e.g., for increases in load on auger(s) 110 within a range capable of impeller 130 and auger(s) 110 maintaining efficient snow removal, etc.). However, since snow moved by auger(s) 110 is provided to impeller 130 (thereby causing increased load on impeller 130), in various embodiments, increased load on auger(s) 110 can trigger impeller control system 140 to increase power to impeller 130, which can occur in addition to or instead of increasing power to auger(s) 110 (in some such scenarios, power to auger(s) 110 can be reduced as impeller 130 sees increased load, as discussed below). Additionally, since snow enters the auger housing via forward motion of the snow thrower, in various embodiments, increased load on auger(s) 110 can trigger drive power control system 160 to decrease power to drive element(s) 150. In some such embodiments, power to drive element(s) 150 can remain constant when load on auger(s) 110 increases, unless the total power used by system 100 is equal to or greater than a given power value (e.g., a maximum, a threshold, etc.).

In various embodiments, reduced load on auger(s) 110 can trigger auger power control system 120 to decrease power to auger(s) 110 and/or trigger impeller power control system 140 to decrease power to impeller 130 (e.g., down to baseline level(s) that can provide for power saving, etc.). In various embodiments, reduced load on auger(s) 110 can trigger drive power control system 160 to increase power to drive element(s) 150 (e.g., up to a preset or user selected level, or until a target ground speed is achieved, for example, to achieve a user-selected ground speed, etc.).

An increased load on impeller 130 can result from increased rate of snow mass moved by impeller 130 (e.g., more (deeper, etc.) snow and/or heavier snow), which is provided to it by auger(s) 110. In various embodiments, in response to an increased load on impeller 130, impeller power control system 140 can increase power to impeller 130. In various embodiments, in response to an increased load on impeller 130, auger power control system 120 can decrease power to auger(s) 110, which can slow the rate of snow being provided to impeller 130, allowing it time to catch up. In various embodiments, in response to an increased load on impeller 130, drive power control system(s) 160 can decrease power to drive element(s) 150, which can also slow the rate of snow provided by auger(s) 110 to impeller 130.

As with a reduced load on auger(s) 110, in various embodiments, reduced load on impeller 130 can trigger auger power control system 120 to decrease power to auger(s) 110 and/or trigger impeller power control system 140 to decrease power to impeller 130 (e.g., down to baseline level(s) that can provide for power saving, etc.). Alternatively, reduced load on impeller 130 can trigger auger power control system 120 to maintain or increase power to auger(s) 110, which can thereby increase the load on impeller 130. In various embodiments, reduced load on impeller 130 can trigger drive power control system 160 to increase power to drive element(s) 150 (e.g., up to a preset or user selected level, or until a target ground speed is achieved, for example, to achieve a user-selected ground speed, etc.).

Increased load on drive element(s) 150 can result from scenarios such as pushing the snow thrower into thicker snow, uphill driving, etc. Increased load on only one drive element 150 of two or more can result from uneven snow or driving conditions between the drive element(s) 150. In various embodiments, increased load on drive element(s) 150 can trigger drive power control system(s) 160 increase power to drive element(s) 150 (e.g., to try to maintain a target ground speed). In various embodiments, power to drive element(s) 150 can be increased only if it would not be decreased due to increased load on auger(s) 110 and/or impeller 130.

In various embodiments, reduced load on drive element(s) 150 can trigger drive power control system(s) 160 to reduce power to drive element(s) 150 (e.g., to a level sufficient to maintain a target ground speed, etc.). In some scenarios, reduced load on drive element(s) 150 below a baseline level for forward motion can be indicative of a loss of traction (which can additionally or alternatively be determined by optional ground speed sensor(s) (not shown)), as drive element(s) 150 are slipping. In such scenarios, one or more of the following can be triggered: drive power control system(s) 160 can reduce power to drive element(s) 150 (e.g., slowing or stopping drive element(s) 150 can facilitate regaining traction); auger power control system 120 can increase power to auger(s) 110; and/or impeller power control system 140 can increase power to impeller 130.

Some combinations of load conditions can also be indicative of potential problems that may warrant user intervention. As one example, an increased load on auger(s) 110 is generally indicative of increased mass of snow that will soon move to impeller 130, increasing its load as well. If, however, the load on auger(s) 110 remains high but the load on impeller 130 remains low for a sufficient period, it can potentially be the result of snow or ice buildup in the housing of auger(s) 110 that is not being cleared and moved to impeller 130. In some such scenarios, a user can be notified, for example, to shut down the snow thrower, investigate, and resolve such an issue.

Various embodiments can prioritize power at one or more of auger(s) 110, impeller 130, and/or drive element(s) 150, in situations in which power might be reduced. In many situations, the impeller 130 can be a chokepoint, and prioritizing impeller 130 to maintain the ability of impeller 130 to clear snow can maintain efficient snow clearing in situations involving higher loads. As another example, embodiments can attempt to maintain a target ground speed via power to drive element(s) 150 regardless of load on the auger(s) 110 and/or impeller 130, and only reduce power to drive element(s) 150 when increasing power to auger(s) 110 and/or impeller 130 is no longer possible (e.g., the combination has reached a threshold (e.g., maximum) power level, but the scenario calls for power to auger(s) 110 and/or impeller 130 to be increased further, etc.). Additionally or alternatively, total power can be conserved by managing power at auger(s) 110, impeller 130, and/or drive element(s) 150 to be at or near a minimum power consumption sufficient for current operating conditions (e.g., or current operating conditions at the target ground speed, etc.).

As discussed above, in response to a load change on auger(s) 110, impeller 130, and/or drive element(s) 150, power (e.g., or speed, etc.) can be increased or decreased on one or more of auger(s) 110, impeller 130, and/or drive element(s) 150, and in situations in which more than one power change can be applied, those power changes can occur one of simultaneously or sequentially, and can occur always or when one or more conditions apply. As an example of sequential power changes that depend on conditions, in some embodiments, increased load on impeller 130 can result in increased power to impeller 130, can optionally then result in decreased power to auger(s) 110 if power to the impeller 130 was increased to a first given level (e.g., maximum available power, etc.) without sufficient reducing the load on impeller 130, and also can optionally result in decreased power to drive element(s) 150 if increasing power to impeller 130 to the first given level and decreasing power to auger(s) 110 to a second given level (e.g., a minimum operating power, stopped, etc.) did not sufficiently reduce the load on impeller 130.

Additionally, various embodiments can provide for the option to increase or decrease power to one or more of auger(s) 110, impeller 130, and/or drive element(s) 150 via user input (e.g., individual controls, a single "boost" button/switch/etc. that increases power to two or more, for example, auger(s) 110 and impeller 130, etc.).

Referring to FIGS. 4-7, an example three-stage snow thrower 10 is shown. Although FIGS. 4-7 show an example three-stage snow thrower, various embodiments discussed herein can comprise power management systems, methods, and snow throwers that can be employed in connection with or can be any of a variety of multi-stage snow throwers (e.g., two-stage, three-stage, four-stage, etc.) that provide independent driving of two or more of an auger, an impeller, and/or drive element(s) (e.g., wheels, tracks, etc.). In the illustrated embodiment, the snow thrower 10 includes a power supply 12 configured to provide power for driving the three stages used to remove or throw accumulated snow from concrete, pavement, or the like. It should be understood by one of ordinary skill in the art that the snow thrower 10 may alternatively include a cord to receive electrical power, an internal combustion engine, a rechargeable battery, or any other commonly known power supplies. The snow thrower 10 also includes a pair of graspable handles (not shown) attached to the power supply that can be used by an operator to control the direction and movement of the snow thrower 10. The snow thrower 10 also includes drive element(s) (e.g., tracks or a pair of wheels, etc.) (not shown) attached to the power supply for allowing the snow thrower to roll along the ground while removing accumulated snow. The snow thrower 10 is configured to remove piled-up snow and propels or throws the snow to a different location from a chute 16 that is operatively connected to a housing 18 into which the piled-up snow enters the snow thrower 10.

The housing 18 is a generally semi-cylindrical, or C-shaped casing including a recess 20 extending rearwardly from the central C-shaped portion, wherein the housing 18 is longitudinally oriented in a transverse direction relative to the forward direction of movement of the snow thrower 10, as shown in FIGS. 4-7. In an embodiment, the housing 18 and recess 20 are formed of a metal material having a thickness sufficient to withstand lower temperatures as well as the repeated impact of snow and debris that is being removed from a sidewalk, driveway, parking lot, or the like. The housing 18 includes an opening 22 into which snow enters the housing 18 and an outlet aperture 24 through which the snow is forced to exit the housing 18 into the recess 20.

In the embodiment illustrated in FIGS. 4-7, the power supply 12 includes a longitudinal drive shaft 26 that extends from the power supply 12 into the housing 18 for providing rotational power to each of the three stages of the snow thrower 10. The power supply 12 selectively drives or rotates the longitudinal drive shaft 26, wherein the power supply 12 can cause the longitudinal drive shaft 26 to always rotate when the power supply 12 is in an on mode, the operator can selectively determine when the power supply 12 engages or causes the longitudinal drive shaft 26 to rotate, or the longitudinal drive shaft 26 does not rotate when the power supply 12 is in an off mode. One distal end of the longitudinal drive shaft 26 is connected to the power supply 12 and the opposing end of the longitudinal drive shaft 26 is operatively connected to a gear assembly 28 that is positioned within the housing 18. In an embodiment, the longitudinal drive shaft 26 extends to the gear assembly 28 such that the distal end of the longitudinal drive shaft 26 is disposed within the gear assembly 28. In another embodiment, one distal end of the longitudinal drive shaft 26 is connected to the power supply 12 and the longitudinal drive shaft 26 extends through the gear assembly 28 such that the opposing distal end of the longitudinal drive shaft 26 extends axially beyond the gear assembly 28. The longitudinal drive shaft 26 is aligned such that the longitudinal axis thereof is substantially aligned with the fore/aft direction of the three-stage snow thrower 10. In an embodiment, the longitudinal drive shaft 26 includes a worm gear (not shown) formed on a portion the outer surface thereof that is positioned within the gear assembly 28 to cooperate with the gears (not shown) disposed therein.

As shown in FIGS. 4-7, a single lateral drive shaft 30 is rotatably attached to each of the opposing side walls of the housing 18, wherein a portion of the lateral drive shaft 30 is disposed within the casing of the gear assembly 28. The lateral drive shaft 30 is operatively connected to the gear assembly 28 in a substantially perpendicular or transverse manner relative to the longitudinal drive shaft 26. The gear assembly 28 includes a casing in which rotational power from the power supply 12 via the longitudinal drive shaft 26 generates or transfers rotational power to the lateral drive shaft 30. In an embodiment, the lateral drive shaft 30 includes a worm gear (not shown) formed into the outer surface thereof, similar to the worm gear (not shown) formed onto the outer surface of the longitudinal drive shaft 26. The longitudinal drive shaft 26 and the lateral drive shaft 30 are operatively connected to all three stages of the three-stage snow thrower 10, thereby providing rotational power to each of the stages so as to quickly and efficiently move, or throw, accumulated snow.

The first stage assembly 32 of the three-stage snow thrower 10 includes at least two augers 34, wherein at least one auger 34 is attached to each portion of the lateral drive shaft 30 extending from the gear assembly 28, as shown in FIGS. 4-7. In the illustrated exemplary embodiment, the first stage assembly 32 includes one (1) auger 34 positioned on each portion of the lateral drive shaft 30 extending from the gear assembly 28. It should be understood by one of ordinary skill in the art that although the illustrated embodiment of the first stage assembly 32 includes only two augers 34, the first stage assembly 32 can include any number of augers 34 positioned adjacent to each side of the gear assembly 28 on the lateral drive shaft 30. The augers 34 are removably connected to the longitudinal and lateral drive shafts 26, 30 by way of a connecting mechanism such as a nut-and-bolt, cotter pin, or the like. The augers 34 of the first stage assembly 32 are configured to move snow axially along the lateral drive shaft 30, wherein the augers 34 located on opposing portions of the lateral drive shaft 30 relative to the gear assembly 28 are configured to move snow in an opposing manner relative to the augers 34 on the opposing portion of the lateral drive shaft 30. As such, the augers 34 of the first stage assembly 32 are configured to move snow, ice and other material toward the center of the housing 18, or toward the gear assembly 28 that is positioned at or near the center of the housing 18.

Each auger 34 includes at least one flight 36 that extends radially outward from a base 38 as well as extending at least somewhat concentrically with the outer surface of the base 38. In the illustrated embodiment, the flights 36 include a base portion that extends radially from the base 38 in a generally linear manner, and an arc-shaped blade portion that expands from the end of the base portion in a generally semi-circular manner about the base 38. The blade portion of the flight 36 is also curved, or angled in a helical manner about the base 38. The blade portion of each flight 36 extends about the base 38 about one hundred eighty (180) degrees such that two flights 36 extending about the entire periphery of the base 38. In another embodiment, each auger 34 has a single flight 36 that extends helically about the entire periphery of the base 38 in a helical manner. In yet another embodiment, each auger 34 includes more than two flights 36 extending from the base 38 such that all of the flights 36 extend about at least the entire periphery of the base 38. The augers 34 can be formed of segmented or continuous flights 36, or the augers 34 may include brushes incorporated with the flights 36. It should be understood by one of ordinary skill in the art that the augers 34 are configured in a corkscrew or spiral shape or orientation relative to the drive shaft 26, 30 to which they are attached such that rotation of the augers 34 push snow along the axis of rotation of the respective drive shaft. For example, the augers 34 of the first stage assembly 32 are configure to rotate and push or transport the snow in the direction from the side walls of the housing 18 toward the centrally-located gear assembly 28, and in a similar manner, the second stage assembly 40 is configured to rotate and push or transport the snow in the rearward direction from near the gear assembly 28 toward the recess 20.

In an embodiment, the second stage assembly 40 includes at least one auger 34 operatively connected to the longitudinal drive shaft 26, as shown in FIGS. 4-7. As explained above, the longitudinal drive shaft 26 extends from the power supply 12 to the gear assembly 28, and in the illustrated embodiment, the longitudinal drive shaft 26 also extends through and from the opposing side of the gear assembly 28. In the illustrated exemplary embodiment, one auger 34 is operatively connected to the longitudinal drive shaft 26 on the portion of the drive shaft that extends beyond the gear assembly 28 and another auger 34 is operatively connected to the longitudinal drive shaft 26 between the gear assembly 28 and the power supply 12. In an embodiment, both augers 34 are positioned immediately adjacent to the gear assembly 28. It should be understood by one of ordinary skill in the art that although the illustrated embodiment of the second stage assembly 40 includes only two augers 34, the second stage assembly 40 can include any number of augers 34 positioned adjacent to the gear assembly 28 on each of the longitudinal drive shaft 26. The augers 34 of the second stage assembly 40 are oriented such that the augers 34 drive the snow toward the rear of the housing 18 and toward the third stage assembly 42 positioned within the recess 20.

Figure 4:
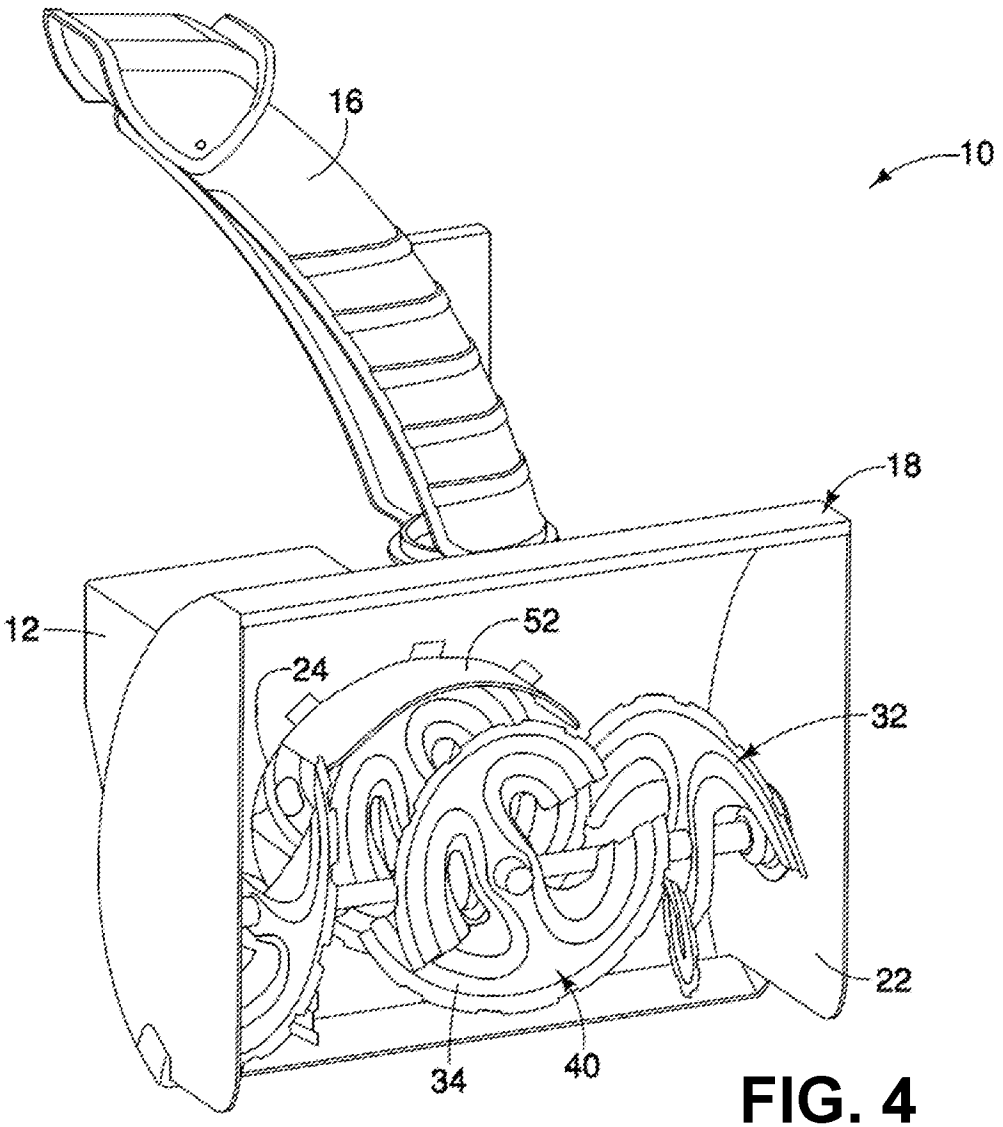
FIG. 4 is a top perspective view of a portion of a three-stage snow thrower employable in connection with various aspects discussed herein.
Figure 6:
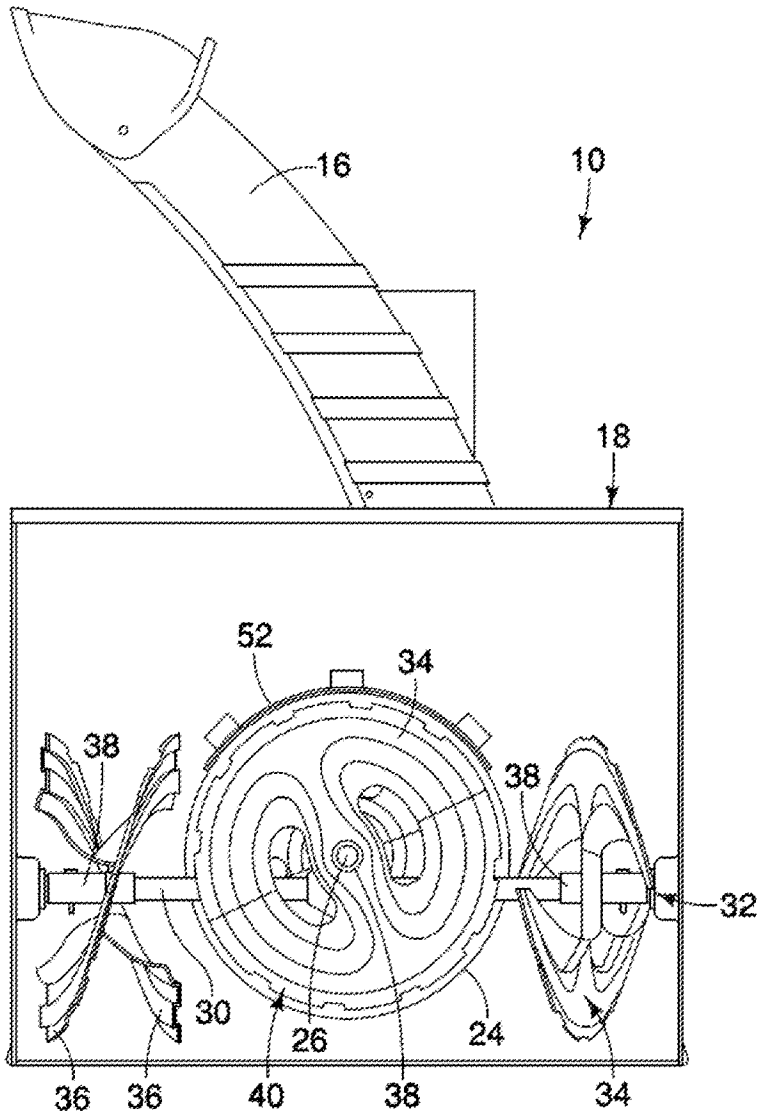
FIG. 6 is a front view of the snow thrower shown in FIG. 4.
Figure 5:
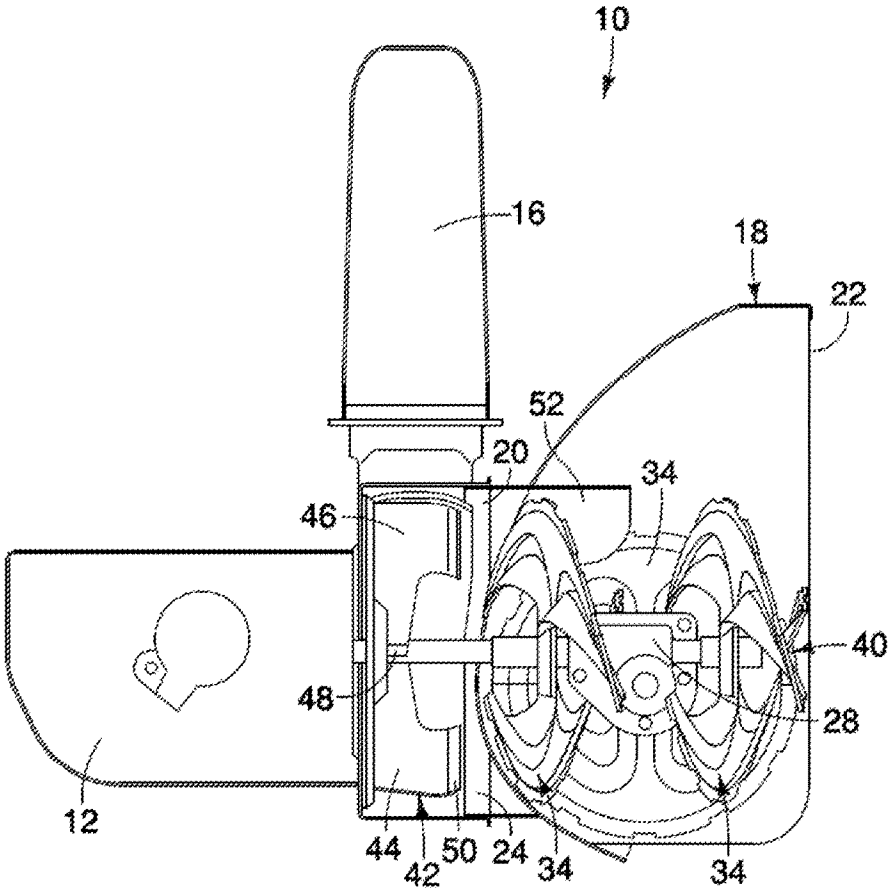
FIG. 5 is a side cross-sectional view of the snow thrower shown in FIG. 4.
Figure 7:
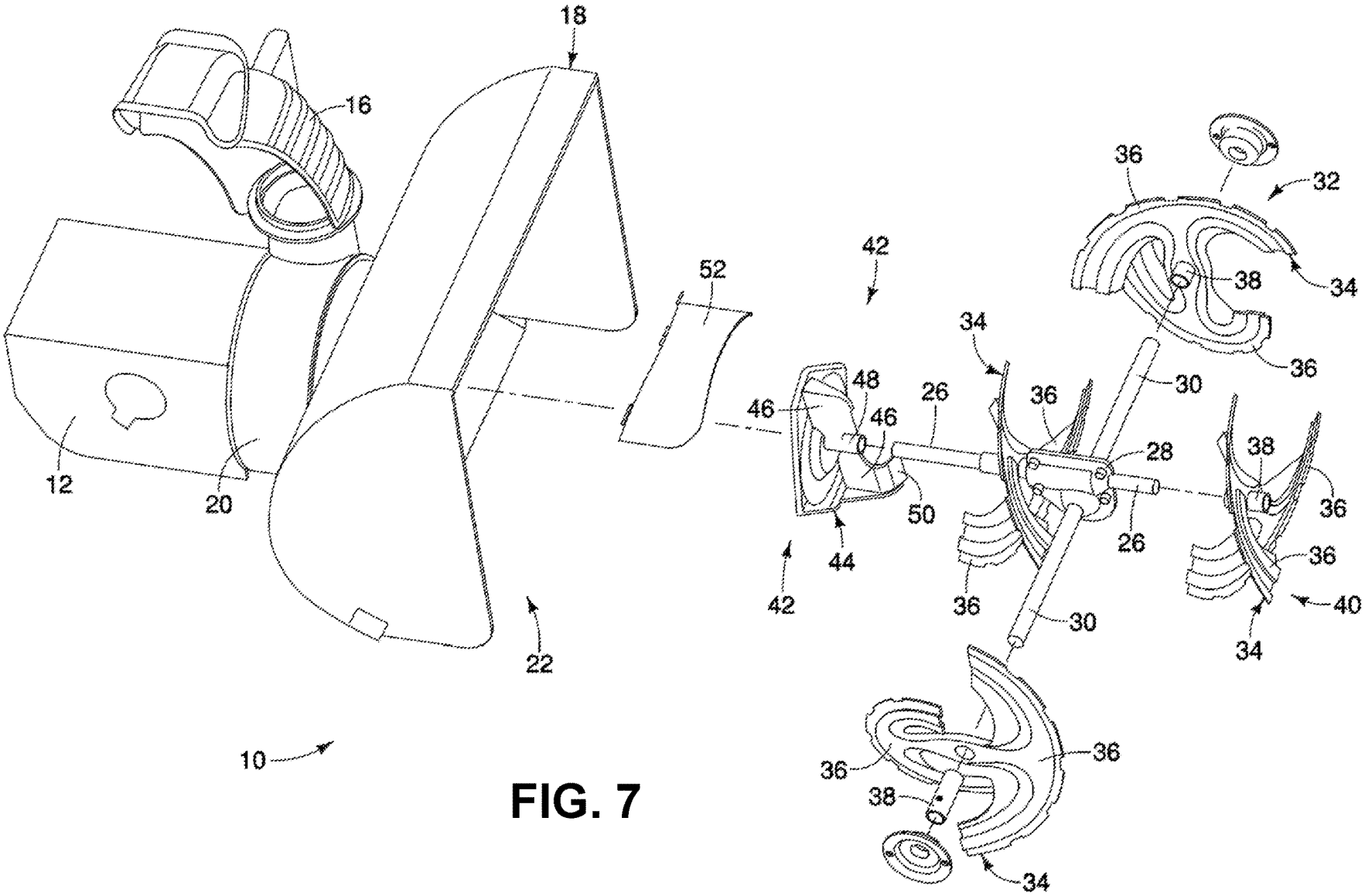
FIG. 7 is an exploded view of the snow thrower shown in FIG. 4.

In an embodiment, the third stage assembly 42 includes a rotatable impeller 44 operatively connected to the longitudinal drive shaft 26 and positioned within the recess 20, as shown in FIGS. 4, 5, and 7. The impeller 44 is located on the longitudinal drive shaft 26 between the downstream-most auger 34 of the second stage assembly 40 and the power supply 12. The impeller 44 is configured to receive the snow from the second stage assembly 40, and through rotation of the impeller 44 about the longitudinal drive shaft 26 at a sufficient speed the snow is expelled or centrifugally thrown by the third stage assembly 42 through the chute 16 and away from the snow thrower 10. In an embodiment, the impeller 44 is removably attached to the longitudinal drive shaft 26 such that the impeller 44 can be removed and replaced. The impeller 44 can be attached to the longitudinal drive shaft 26 with any attachment mechanism such as nut-and-bolt, cotter pin, or the like.

As shown in FIGS. 5 and 7, an exemplary embodiment of an impeller 44 includes a plurality of blades 46 that extend radially outwardly from a base 38, wherein the impeller 44 is attached to the longitudinal drive shaft 26 by sliding the base 38 over the outer surface of the longitudinal drive shaft 26 and securing the impeller 44 to the drive shaft 34 by way of an attachment mechanism such as a nut-and-bolt, a cotter pin, or the like. In an embodiment, each blade 46 includes a tip 50 that extends from the end of the blade 46 in a curved manner. The tips 50 are curved in the direction of rotation of the impeller 44. The curved tips 50 assist in maintaining contact between the snow and the blades 46 as the impeller 44 rotates, thereby preventing the snow from sliding past the ends of the blades 46 to the gap between the blades 46 and the recess 20 before the snow is thrown into and from the chute 16. Preventing the snow from sliding past the end of the blades 46 results in less re-circulation of the snow within the recess 20, thereby making the snow thrower 10 more efficient in expelling the snow. Whereas the augers 34 are configured to push snow axially along the axis of rotation of the auger 34, the impeller 44 is configured to drive or throw snow in a radial direction away from the axis of rotation of the impeller 44. The impeller 44 and the auger 34 immediately adjacent thereto are oriented and timed such that they rotate at the same angular velocity, wherein as the snow slides from the end of the flight 36 of the auger 34 toward the impeller 44, the impeller 44 is positioned such that the snow enters the gap between adjacent blades 46 of the impeller 44 so that re-circulation of the snow is reduced.

In another embodiment, the impeller 44 and the augers 34 of the second stage assembly 40 positioned between the gear assembly 28 and the impeller 44 are attached to a hollow secondary shaft (not shown) that is hollow. This secondary shaft is positioned around the longitudinal drive axis 26 that extends between the power supply 12 and the gear assembly 28. This secondary shaft is configured to provide rotation power to the impeller 44 and the auger(s) 34 via the gear assembly 28. The longitudinal drive shaft 26 is driven by the power supply 12 and is rotatably connected to the gear assembly 28, wherein the rotational power is transferred from the longitudinal drive shaft 26 to the secondary shaft as well as the lateral drive shaft 30 by way of the gears in the gear assembly 28.

The gear assembly 28 is configured to transfer the rotational power from the power supply 12 via the longitudinal drive shaft 26 to the lateral drive shaft 30. In an embodiment, the worm gears (not shown) formed on the outer surfaces of both the longitudinal and lateral drive shafts 26, 30 are directly meshed within the gear assembly 28 such that the rotational power is directly transferred. Accordingly, both the longitudinal and lateral drive shafts 26, 30 rotate at substantially the same rotational velocity. In another embodiment, the gear assembly 28 includes at least one gear that operatively connects the longitudinal drive shaft 26 to the lateral drive shaft 30 to indirectly transfer rotational power from the longitudinal drive shaft 26 to the lateral drive shaft 30. In an embodiment, the gear assembly 28 includes a multiplier (not shown) operatively connecting the longitudinal and lateral drive shafts 26, 30, wherein the multiplier produces an increased rotational ratio such that the lateral drive shaft 30 rotates at an angular velocity that is greater than the rotational velocity of the longitudinal drive shaft 26. In another embodiment, the gear assembly 28 includes a reducer (not shown) operatively connecting the longitudinal and lateral drive shafts 26, 30, wherein the reducer produces an reduced rotational ratio such that the lateral drive shaft 30 rotates at an angular velocity that is less than the rotational velocity of the longitudinal drive shaft 26. It should be understood by one of ordinary skill in the art that any number of gears can be positioned between the longitudinal and lateral drive shafts 26, 30 to transfer rotational power therebetween.

In an embodiment, the snow thrower 10 also includes a baffle 52 positioned within and attached to the housing 18 such that it surrounds the opening to the recess 20, as shown in FIGS. 4-7. The baffle 52 is an arcuate, or curved member having a radius of curvature that is substantially the same as the radius of curvature of the opening to the recess 20. In an embodiment, the baffle 52 includes a plurality of tabs that are welded to the housing 18. In another embodiment, the baffle 52 is directly welded to the housing 18. In yet another embodiment, the baffle 52 is releasably connected to the housing 18 by way of bolts or other releasable mechanical connectors. In a further embodiment, the baffle 52 is integrally formed with the housing 18. The baffle 52 is configured to assist in reducing or restraining the amount of snow that is re-circulated within the housing 12 by limiting the amount of snow leaving the augers 34 of the second stage assembly 40 centripetally, wherein the baffle 52 then directs the snow toward the impeller 44 of the third stage assembly 42 to be expelled via the chute 16. The baffle 52 can be made by any resilient material such as steel, aluminum, or any other type of metal or hard plastic that can withstand the stresses and temperature conditions of the snow thrower 10.

The longitudinal drive shaft 26 is powered by the power supply 12 such that the longitudinal drive shaft rotates between about 50 to about 1500 RPM. In an embodiment, the impeller 44 of the third stage assembly 42 and the augers 34 of the second stage assembly 42 are operatively connected to the longitudinal drive shaft 26 such that the impeller 44 and the second stage assembly augers 34 rotate at substantially the same rotational velocity as the longitudinal drive shaft 26. The rotational power of the longitudinal drive shaft 26 is transferred to the lateral drive shaft 30 by way of the gear assembly 28. In the illustrated exemplary embodiment, the gear assembly 28 is configured to transfer rotational power from the longitudinal drive shaft 26 to the lateral drive shaft 30, whereby the lateral drive shaft 30 can rotate at the same rotational velocity as the longitudinal drive shaft 26, a slower rotational velocity relative to the longitudinal drive shaft 26, or a faster rotational velocity relative to the longitudinal drive shaft 26. In some embodiments, the augers 34 of the first stage assembly 32 can rotate at the same rotational velocity as the lateral drive shaft 30. As the augers 34 of the first stage assembly 32 rotate about a lateral rotational axis, these augers 34 break up the accumulated snow and ice and push this loosened snow axially toward the second stage assembly 40. The upstream augers 34 of the second stage assembly 40 positioned forward of the gear assembly 28 also are configured to assist in breaking up the accumulated snow and ice. All of the augers 34 of the second stage assembly 40 are also configured to push the loosened snow as well as the snow from the first stage assembly 40 axially. The first stage assembly 32 pushes the loosened snow axially in a lateral manner, whereas the second stage assembly 40 pushes the loosened snow axially in a longitudinal manner toward the third stage assembly 42. As the loosened snow is pushed into the third stage assembly 42, the impeller 44 rotates at a sufficient rotational velocity to push or throw the snow in a radially outward manner through the chute 16 and away from the snow thrower 10.

In an embodiment, the augers 34 of the first stage assembly 32 are configured to rotate at substantially the same rotational velocity as the augers 34 of the second stage assembly 40 and the impeller 44 of the third stage assembly 42. In another embodiment, the augers 34 of the first stage assembly 32 are configured to rotate at a different rotational velocity than the augers 34 of the second stage assembly 40 and the impeller 44 of the third stage assembly 42. In yet another embodiment, the augers 34 of the second stage assembly 40 are configured to rotate at a different angular velocity than the impeller 44 of the third stage assembly 42.

Rotation of the augers 34 of the first stage assembly 32 causes accumulated snow and ice to break up and be and easily moveable or transferrable. This rotation of the augers 34 draws the snow and ice into the housing 18, thereby reducing the amount of forward or longitudinal thrust that must be applied to the snow thrower 10 by the operator. The downward motion of the leading edge of the augers 34 of the first stage assembly 32 tend to drive the snow thrower 10 upwardly as it contacts compacted or accumulated snow and/or other material. The longitudinal orientation of the augers 34 of the second stage assembly 40 tend to reduce this upward movement of the first stage assembly 32 by pulling the accumulated snow into the housing 18, thereby providing forward momentum for the snow thrower 10. The flights 36 of the augers 34 of the second stage assembly 32 provide a force that balances the upward and downward forces on the snow thrower 10.

Figure 8:
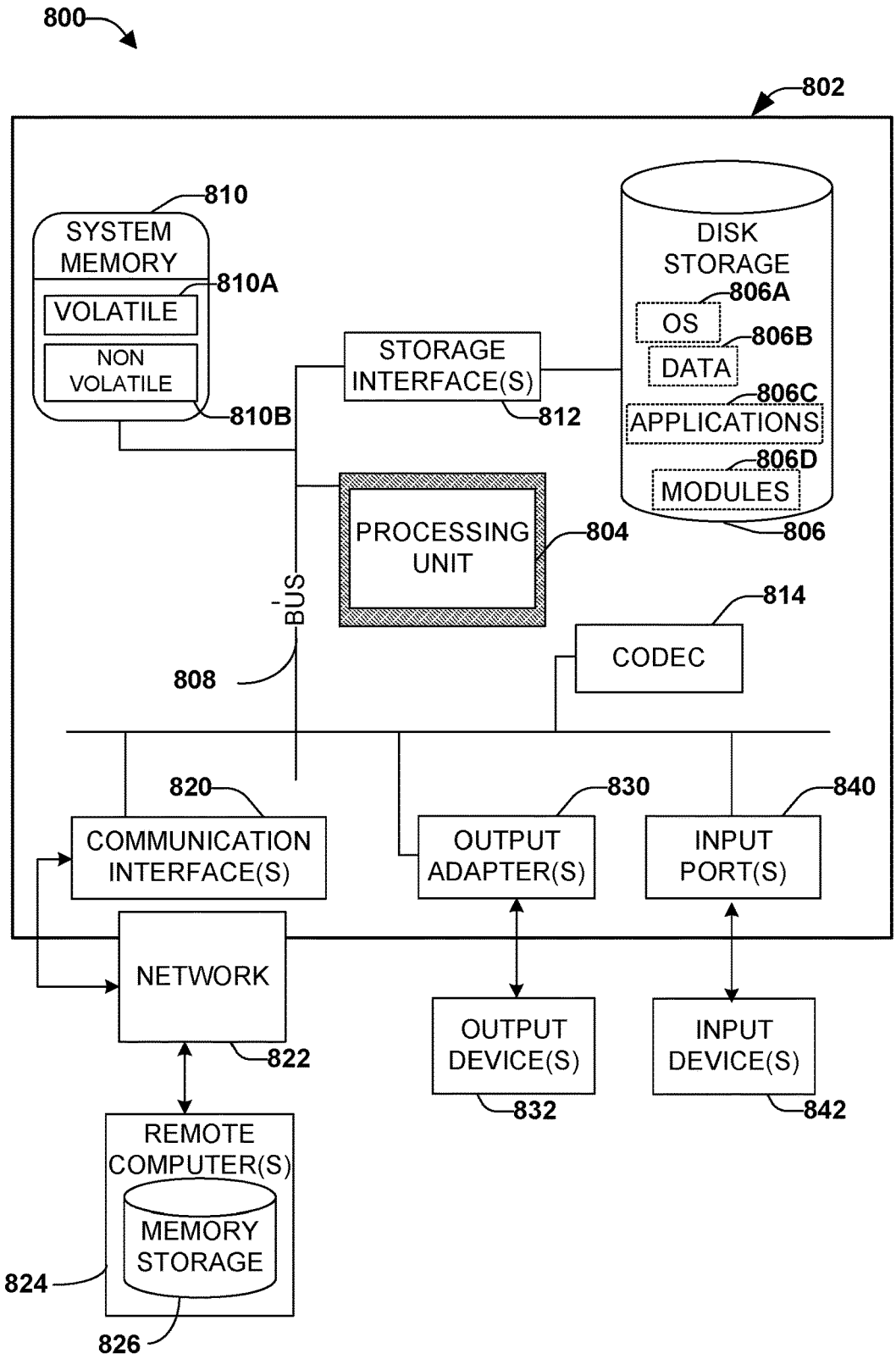
FIG. 8 depicts a diagram of an example computing environment for electronic and data management and computer control for a power equipment machine, in an embodiment.

In connection with FIG. 8, the systems and processes described herein can be embodied within hardware, such as a single integrated circuit (IC) chip, multiple ICs, an application specific integrated circuit (ASIC), or the like. A suitable operating environment 800 for implementing various aspects of the claimed subject matter includes a computer 802. In various embodiments, a control unit (e.g., control unit 280, etc.) of a snow thrower can be embodied in part by computer 802, or an analogous computing device known in the art, subsequently developed, or made known to one of ordinary skill in the art by way of the context provided herein.

The computer 802 includes a processing unit 804, a system memory 810, a codec 814, and a system bus 808. The system bus 808 couples system components including, but not limited to, the system memory 810 to the processing unit 804. The processing unit 804 can be any of various available processors. Dual microprocessors and other multiprocessor architectures also can be employed as the processing unit 804.

The system bus 808 can be any of several types of bus structure(s) including the memory bus or memory controller, a peripheral bus or external bus, or a local bus using any variety of available bus architectures including, but not limited to, Controller Area Network (CAN), Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 810 can include volatile memory 810A, non-volatile memory 810B, or both. Functions of a control unit (among other control units: 280, etc., depicted herein) described in the present specification can be programmed to system memory 810, in various embodiments. The basic input/output system (BIOS), containing the basic routines to transfer information between elements within the computer 802, such as during start-up, is stored in non-volatile memory 810B. In addition, according to present innovations, codec 814 may include at least one of an encoder or decoder, wherein the at least one of an encoder or decoder may consist of hardware, software, or a combination of hardware and software. Although, codec 814 is depicted as a separate component, codec 814 may be contained within non-volatile memory 810B. By way of illustration, and not limitation, non-volatile memory 810B can include read only memory (ROM), programmable ROM (PROM), electrically programmable ROM (EPROM), electrically erasable programmable ROM (EEPROM), or Flash memory. Non-volatile memory 1810B can be embedded memory (e.g., physically integrated with computer 802 or a mainboard thereof), or removable memory. Examples of suitable removable memory can include a secure digital (SD) card, a compact Flash (CF) card, a universal serial bus (USB) memory stick, or the like. Volatile memory 810A includes random access memory (RAM), which can serve as operational system memory for applications executed by processing unit 804. By way of illustration and not limitation, RAM is available in many forms such as static RAM (SRAM), dynamic RAM (DRAM), synchronous DRAM (SDRAM), double data rate SDRAM (DDR SDRAM), and enhanced SDRAM (ESDRAM), and so forth.

Computer 802 may also include removable/non-removable, volatile/non-volatile computer storage medium. FIG. 8 illustrates, for example, disk storage 806. Disk storage 806 includes, but is not limited to, devices such as a magnetic disk drive, solid state disk (SSD) floppy disk drive, tape drive, Flash memory card, memory stick, or the like. In addition, disk storage 806 can include storage medium separately or in combination with other storage medium including, but not limited to, an optical disk drive such as a compact disk ROM device (CD-ROM) or derivative technology (e.g., CD-R Drive, CD-RW Drive, DVD-ROM, and so forth). To facilitate connection of the disk storage 806 to the system bus 808, a removable or non-removable interface is typically used, such as interface 812. In one or more embodiments, disk storage 806 can be limited to solid state non-volatile storage memory, providing motion and vibration resistance for a control unit (e.g., control unit 280, among others) operable in conjunction with a snow thrower (e.g., snow thrower 10, etc.).

It is to be appreciated that FIG. 8 describes software embodied within operating environment 800 that can program computer 802 to manage power between two or more of an auger, impeller, and/or drive element(s) of a snow thrower (e.g., snow thrower 10). Such software includes an operating system 806A. Operating system 806A, which can be stored on disk storage 806, acts to control and allocate resources of the computer 802. Applications 806C take advantage of the management of resources by operating system 806A through program modules 806D, and program data 806B, such as the boot/shutdown transaction table and the like, stored either in system memory 810 or on disk storage 806. It is to be appreciated that the claimed subject matter can be implemented with various operating systems or combinations of operating systems.

Input device(s) 842 connects to the processing unit 804 and facilitates user interaction with operating environment 800 through the system bus 808 via interface port(s) 830. Input port(s) 840 can include, for example, a serial port, a parallel port, a game port, a universal serial bus (USB), among others. Output device(s) 832 use some of the same type of ports as input device(s) 842. Thus, for example, a USB port may be used to provide input to computer 802 and to output information from computer 802 to an output device 832. Output adapter 830 is provided to illustrate that there are some output devices, such as graphic display, speakers, and printers, among other output devices, which require special adapters. The output adapter 830 can include, by way of illustration and not limitation, video and sound cards that provide a means of connection between the output device 832 and the system bus 808. It should be noted that other devices or systems of devices provide both input and output capabilities such as remote computer(s) 824 and memory storage 826.

Computer 802 can operate in conjunction with one or more electronic devices described herein. For instance, computer 802 can facilitate power management between two or more of an auger, impeller, and/or drive element(s), within a snow thrower 10, as described herein. Additionally, computer 802 can communicatively couple with auger power control system 120, impeller power control system 140, and/or drive power control system 160 to manage power for auger(s) 110, impeller 130, and/or drive element(s) 150, respectively, according to one or more aspects discussed herein.

Communication connection(s) 820 refers to the hardware/software employed to connect the network interface 822 to the system bus 808. While communication connection 820 is shown for illustrative clarity inside computer 802, it can also be external to computer 802. The hardware/software necessary for connection to the network interface 822 includes, for exemplary purposes only, internal and external technologies such as, modems including regular telephone grade modems, cable modems and DSL modems, ISDN adapters, and wired and wireless Ethernet cards, hubs, and routers.

In regard to the various functions performed by the above described components, machines, devices, processes and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the embodiments. In this regard, it will also be recognized that the embodiments include a system as well as electronic hardware configured to implement the functions, or a computer-readable medium having computer-executable instructions for performing the acts or events of the various processes.

In addition, while a particular feature may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In other embodiments, combinations or sub-combinations of the above disclosed embodiments can be advantageously made. The block diagrams of the architecture and flow charts are grouped for ease of understanding. However, it should be understood that combinations of blocks, additions of new blocks, re-arrangement of blocks, and the like are contemplated in alternative embodiments of the present disclosure.

The following examples pertain to further embodiments.

Example 1 is a snow thrower, comprising: one or more drive elements configured to move the snow thrower; an impeller configured to expel snow from the snow thrower; one or more augers configured to provide the snow to the impeller; an auger power control system configured to provide a first power to the one or more augers; an impeller power control system configured to provide a second power to the impeller; and a drive power control system configured to provide a third power to the one or more drive elements; wherein, in response to at least one of a user input, a change in a first load on the one or more augers, a change in a second load on the impeller, or a change in a third load on the one or more drive elements, at least one of: the auger power control system is configured to one of increase or decrease the first power; the impeller power control system is configured to one of increase or decrease the second power; or the drive power control system is configured to one of increase or decrease the third power.

Example 2 comprises the subject matter of any variation of example(s) 1, wherein, in response to the change in the second load being an increase, the impeller power control system is configured to increase the second power.

Example 3 comprises the subject matter of any variation of example(s) 1-2, wherein, in response to the change in the second load being an increase, the auger power control system is configured to decrease the first power.

Example 4 comprises the subject matter of any variation of example(s) 1-3, wherein, in response to the change in the second load being an increase, the drive power control system is configured to decrease the third power.

Example 5 comprises the subject matter of any variation of example(s) 1-4, wherein, in response to the change in the first load being an increase, the impeller power control system is configured to increase the second power.

Example 6 comprises the subject matter of any variation of example(s) 1-5, wherein, in response to the change in the first load being a decrease, the auger power control system is configured to decrease the first power.

Example 7 comprises the subject matter of any variation of example(s) 1-6, wherein, in response to the change in the first load being an increase, the drive power control system is configured to decrease the third power.

Example 8 comprises the subject matter of any variation of example(s) 1-7, wherein: the auger power control system comprises an auger motor configured to rotate the one or more augers according to the first power and an auger motor controller configured to drive the auger motor according to the first power, the impeller power control system comprises an impeller motor configured to rotate the impeller according to the second power and an impeller motor controller configured to drive the impeller motor according to the second power, and the drive power control system comprises a drive motor configured to rotate the one or more drive elements according to the third power and a drive motor controller configured to drive the drive motor according to the third power.

Example 9 comprises the subject matter of any variation of example(s) 1-8, further comprising a control unit configured to control at least one of the first power, the second power, or the third power.

Example 10 comprises the subject matter of any variation of example(s) 1-9, further comprising: an additional drive element configured to move the snow thrower; and an additional drive power control system configured to provide a fourth power to the additional drive element, wherein the additional drive element is different than the one or more drive elements, and wherein the additional drive power control system is configured to increase or decrease the fourth power in response to at least one of the user input, the change in the first load on the one or more augers, the change in the second load on the impeller, the change in the third load on the at least one drive element, or a change in a fourth load on the additional drive element.

Example 11 comprises the subject matter of any variation of example(s) 1-10, wherein at least one of: the auger power control system is configured to provide the first power one or more of mechanically, electrically, electronically, hydraulically, hydrostatically, or pneumatically; the impeller power control system is configured to provide the second power one or more of mechanically, electrically, electronically, hydraulically, hydrostatically, or pneumatically; or the drive power control system is configured to provide the third power one or more of mechanically, electrically, electronically, hydraulically, hydrostatically, or pneumatically.

Example 12 is a snow thrower, comprising: one or more drive elements configured to move the snow thrower; an impeller configured to expel snow from the snow thrower; one or more augers configured to provide the snow to the impeller; an auger power control system comprising an auger motor configured to rotate the one or more augers according to a first power and an auger motor controller configured to drive the auger motor according to the first power; an impeller power control system comprising an impeller motor configured to rotate the impeller according to a second power and an impeller motor controller configured to drive the impeller motor according to the second power; and a drive power control system comprising a drive motor configured to rotate the one or more drive elements according to a third power and a drive motor controller configured to drive the drive motor according to the third power; wherein, in response to at least one of a user input, a change in a first load on the one or more augers, a change in a second load on the impeller, or a change in a third load on the at least one drive element, at least one of: the auger power control system is configured to one of increase or decrease the first power; the impeller power control system is configured to one of increase or decrease the second power; or the drive power control system is configured to one of increase or decrease the third power.

Example 13 comprises the subject matter of any variation of example(s) 12, wherein, in response to the change in the second load being an increase, the impeller power control system is configured to increase the second power.

Example 14 comprises the subject matter of any variation of example(s) 12-13, wherein, in response to the change in the second load being an increase, the auger power control system is configured to decrease the first power.

Example 15 comprises the subject matter of any variation of example(s) 12-14, wherein, in response to the change in the second load being an increase, the drive power control system is configured to decrease the third power.

Example 16 comprises the subject matter of any variation of example(s) 12-15, wherein, in response to the change in the first load being an increase, the impeller power control system is configured to increase the second power.

Example 17 comprises the subject matter of any variation of example(s) 12-16, wherein, in response to the change in the first load being a decrease, the auger power control system is configured to decrease the first power.

Example 18 comprises the subject matter of any variation of example(s) 12-17, wherein, in response to the change in the first load being an increase, the drive power control system is configured to decrease the third power.

Example 19 comprises the subject matter of any variation of example(s) 12-18, further comprising a control unit configured to control at least one of the first power, the second power, or the third power.

Example 20 comprises the subject matter of any variation of example(s) 12-19, further comprising an additional drive power control system configured to provide a fourth power to an additional drive element of the one or more drive elements, wherein the additional drive element is different than the at least one of the one or more drive elements, and wherein the additional drive power control system is configured to increase or decrease the fourth power in response to at least one of the user input, the change in the first load on the one or more augers, the change in the second load on the impeller, the change in the third load on the at least one drive element, or a change in a fourth load on the additional drive element.

Example 21 is a power management system for a snow thrower, comprising: an auger power control system configured to provide a first power to one or more augers; an impeller power control system configured to provide a second power to an impeller; and a drive power control system configured to provide a third power to one or more drive elements; wherein, in response to at least one of a user input, a change in a first load on the one or more augers, a change in a second load on the impeller, or a change in a third load on the one or more drive elements, at least one of: the auger power control system is configured to one of increase or decrease the first power; the impeller power control system is configured to one of increase or decrease the second power; or the drive power control system is configured to one of increase or decrease the third power.

Example 22 comprises the subject matter of any variation of example(s) 21, wherein, in response to the change in the second load being an increase, the impeller power control system is configured to increase the second power.

Example 23 comprises the subject matter of any variation of example(s) 21-22, wherein, in response to the change in the second load being an increase, the auger power control system is configured to decrease the first power.

Example 24 comprises the subject matter of any variation of example(s) 21-23, wherein, in response to the change in the second load being an increase, the drive power control system is configured to decrease the third power.

Example 25 comprises the subject matter of any variation of example(s) 21-24, wherein, in response to the change in the first load being an increase, the impeller power control system is configured to increase the second power.

Example 26 comprises the subject matter of any variation of example(s) 21-25, wherein, in response to the change in the first load being a decrease, the auger power control system is configured to decrease the first power.

Example 27 comprises the subject matter of any variation of example(s) 21-26, wherein, in response to the change in the first load being an increase, the drive power control system is configured to decrease the third power.

Example 28 comprises the subject matter of any variation of example(s) 21-27, wherein: the auger power control system comprises an auger motor configured to rotate the one or more augers according to the first power and an auger motor controller configured to drive the auger motor according to the first power, the impeller power control system comprises an impeller motor configured to rotate the impeller according to the second power and an impeller motor controller configured to drive the impeller motor according to the second power, and the drive power control system comprises a drive motor configured to rotate the one or more drive elements according to the third power and a drive motor controller configured to drive the drive motor according to the third power.

Example 29 comprises the subject matter of any variation of example(s) 21-28, further comprising a control unit configured to control at least one of the first power, the second power, or the third power.

Example 30 comprises the subject matter of any variation of example(s) 21-29, further comprising: an additional drive element configured to move the snow thrower; and an additional drive power control system configured to provide a fourth power to the additional drive element, wherein the additional drive element is different than the one or more drive elements, and wherein the additional drive power control system is configured to increase or decrease the fourth power in response to at least one of the user input, the change in the first load on the one or more augers, the change in the second load on the impeller, the change in the third load on the at least one drive element, or a change in a fourth load on the additional drive element.

Example 31 comprises the subject matter of any variation of example(s) 21-30, wherein at least one of: the auger power control system is configured to provide the first power one or more of mechanically, electrically, electronically, hydraulically, hydrostatically, or pneumatically; the impeller power control system is configured to provide the second power one or more of mechanically, electrically, electronically, hydraulically, hydrostatically, or pneumatically; or the drive power control system is configured to provide the third power one or more of mechanically, electrically, electronically, hydraulically, hydrostatically, or pneumatically.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A snow thrower, comprising:

no more than one electric motor;

one or more drive elements configured to move the snow thrower;

an impeller configured to expel snow from the snow thrower;

one or more augers configured to provide the snow to the impeller;

an auger power control system configured to provide a first power to the one or more augers;

an impeller power control system configured to provide a second power to the impeller;

a drive power control system configured to provide a third power to the one or more drive elements;

wherein, in response to at least one of a user input, a change in a first load on the one or more augers, a change in a second load on the impeller, or a change in a third load on the one or more drive elements, at least one of:

the auger power control system is configured to one of increase or decrease the first power;

the impeller power control system is configured to one of increase or decrease the second power; or the drive power control system is configured to one of increase or decrease the third power; and a sensor adapted to detect the load at the one or more augers, impeller, or one or more drive elements.

2. The snow thrower of claim 1, wherein, in response to the change in the second load being an increase, the impeller power control system is configured to increase the second power.

3. The snow thrower of claim 1, wherein, in response to the change in the second load being an increase, the auger power control system is configured to decrease the first power.

4. The snow thrower of claim 1, wherein, in response to the change in the second load being an increase, the drive power control system is configured to decrease the third power.

5. The snow thrower of claim 1, wherein, in response to the change in the first load being an increase, the impeller power control system is configured to increase the second power.

6. The snow thrower of claim 1, wherein, in response to the change in the first load being a decrease, the auger power control system is configured to decrease the first power.

7. The snow thrower of claim 1, wherein, in response to the change in the first load being an increase, the drive power control system is configured to decrease the third power.

8. The snow thrower of claim 1, wherein:

the auger power control system comprises an auger motor configured to rotate the one or more augers according to the first power and an auger motor controller configured to drive the auger motor according to the first power, the impeller power control system comprises an impeller motor configured to rotate the impeller according to the second power and an impeller motor controller configured to drive the impeller motor according to the second power, and the drive power control system comprises a drive motor configured to rotate the one or more drive elements according to the third power and a drive motor controller configured to drive the drive motor according to the third power.

9. The snow thrower of claim 1, further comprising a control unit configured to control at least one of the first power, the second power, or the third power.

10. The snow thrower of claim 1, further comprising:

an additional drive element configured to move the snow thrower; and an additional drive power control system configured to provide a fourth power to the additional drive element, wherein the additional drive element is different than the one or more drive elements, and wherein the additional drive power control system is configured to increase or decrease the fourth power in response to at least one of the user input, the change in the first load on the one or more augers, the change in the second load on the impeller, the change in the third load on the at least one drive element, or a change in a fourth load on the additional drive element.

11. The snow thrower of claim 1, wherein at least one of: the auger power control system is configured to provide the first power one or more of mechanically, electrically, electronically, hydraulically, hydrostatically, or pneumatically; the impeller power control system is configured to provide the second power one or more of mechanically, electrically, electronically, hydraulically, hydrostatically, or pneumatically; or the drive power control system is configured to provide the third power one or more of mechanically, electrically, electronically, hydraulically, hydrostatically, or pneumatically.

12. A snow thrower, comprising:

no more than one electric motor;

one or more drive elements configured to move the snow thrower;

an impeller configured to expel snow from the snow thrower;

one or more augers configured to provide the snow to the impeller;

an auger power control system comprising an auger motor configured to rotate the one or more augers according to a first power and an auger motor controller configured to drive the auger motor according to the first power;

an impeller power control system comprising an impeller motor configured to rotate the impeller according to a second power and an impeller motor controller configured to drive the impeller motor according to the second power;

a drive power control system comprising a drive motor configured to rotate the one or more drive elements according to a third power and a drive motor controller configured to drive the drive motor according to the third power;

wherein, in response to at least one of a user input, a change in a first load on the one or more augers, a change in a second load on the impeller, or a change in a third load on the at least one drive element, at least one of:

the auger power control system is configured to one of increase or decrease the first power;

the impeller power control system is configured to one of increase or decrease the second power; or the drive power control system is configured to one of increase or decrease the third power; and a sensor adapted to detect the load at the one or more augers, impeller, or one or more drive elements.

13. The snow thrower of claim 12, wherein, in response to the change in the second load being an increase, the impeller power control system is configured to increase the second power.

14. The snow thrower of claim 12, wherein, in response to the change in the second load being an increase, the auger power control system is configured to decrease the first power.

15. The snow thrower of claim 12, wherein, in response to the change in the second load being an increase, the drive power control system is configured to decrease the third power.

16. The snow thrower of claim 12, wherein, in response to the change in the first load being an increase, the impeller power control system is configured to increase the second power.

17. The snow thrower of claim 12, wherein, in response to the change in the first load being a decrease, the auger power control system is configured to decrease the first power.

18. The snow thrower of claim 12, wherein, in response to the change in the first load being an increase, the drive power control system is configured to decrease the third power.

19. The snow thrower of claim 12, further comprising a control unit configured to control at least one of the first power, the second power, or the third power.

20. The snow thrower of claim 12, further comprising an additional drive power control system configured to provide a fourth power to an additional drive element of the one or more drive elements, wherein the additional drive element is different than the at least one of the one or more drive elements, and wherein the additional drive power control system is configured to increase or decrease the fourth power in response to at least one of the user input, the change in the first load on the one or more augers, the change in the second load on the impeller, the change in the third load on the at least one drive element, or a change in a fourth load on the additional drive element.

21. A power management system of a snow thrower, comprising:

no more than one electric motor;

one or more drive elements configured to move the snow thrower;

an impeller configured to expel snow from the snow thrower;

one or more augers configured to provide snow to the impeller;

an auger power control system configured to provide a first power to the one or more augers;

an impeller power control system configured to provide a second power to the impeller; and a drive power control system configured to provide a third power to the one or more drive elements;

wherein, in response to at least one of a user input, a change in a first load on the one or more augers, a change in a second load on the impeller, or a change in a third load on the one or more drive elements, at least one of:

the auger power control system is configured to one of increase or decrease the first power;

the impeller power control system is configured to one of increase or decrease the second power; or the drive power control system is configured to one of increase or decrease the third power; and a sensor adapted to detect the load at the one or more augers, impeller, or one or more drive elements.

22. The power management system of claim 21, wherein, in response to the change in the second load being an increase, the impeller power control system is configured to increase the second power.

23. The power management system of claim 21, wherein, in response to the change in the second load being an increase, the auger power control system is configured to decrease the first power.

24. The power management system of claim 21, wherein, in response to the change in the second load being an increase, the drive power control system is configured to decrease the third power.

25. The power management system of claim 21, wherein, in response to the change in the first load being an increase, the impeller power control system is configured to increase the second power.

26. The power management system of claim 21, wherein, in response to the change in the first load being a decrease, the auger power control system is configured to decrease the first power.

27. The power management system of claim 21, wherein, in response to the change in the first load being an increase, the drive power control system is configured to decrease the third power.

28. The power management system of claim 21, wherein:

the auger power control system comprises an auger motor configured to rotate the one or more augers according to the first power and an auger motor controller configured to drive the auger motor according to the first power, the impeller power control system comprises an impeller motor configured to rotate the impeller according to the second power and an impeller motor controller configured to drive the impeller motor according to the second power, and the drive power control system comprises a drive motor configured to rotate the one or more drive elements according to the third power and a drive motor controller configured to drive the drive motor according to the third power.

29. The power management system of claim 21, further comprising a control unit configured to control at least one of the first power, the second power, or the third power.

30. The power management system of claim 21, further comprising:

an additional drive element configured to move the snow thrower; and an additional drive power control system configured to provide a fourth power to the additional drive element, wherein the additional drive element is different than the one or more drive elements, and wherein the additional drive power control system is configured to increase or decrease the fourth power in response to at least one of the user input, the change in the first load on the one or more augers, the change in the second load on the impeller, the change in the third load on the at least one drive element, or a change in a fourth load on the additional drive element.

31. The power management system of claim 21, wherein at least one of: the auger power control system is configured to provide the first power one or more of mechanically, electrically, electronically, hydraulically, hydrostatically, or pneumatically; the impeller power control system is configured to provide the second power one or more of mechanically, electrically, electronically, hydraulically, hydrostatically, or pneumatically; or the drive power control system is configured to provide the third power one or more of mechanically, electrically, electronically, hydraulically, hydrostatically, or pneumatically.

* * * * *